US009797149B2

(12) United States Patent
Lavery et al.

(10) Patent No.: US 9,797,149 B2
(45) Date of Patent: Oct. 24, 2017

(54) TIMBER FRAME STRUCTURES WITH IMPROVED JOINT ASSEMBLIES

(71) Applicant: Western Timber Frame, Inc., Lehi, UT (US)

(72) Inventors: Brad Lavery, Eagle Mountain, UT (US); Joseph Hyrum Thompson, Eagle Mountain, UT (US)

( * ) Notice: Subject to any disclaimer, the term of this patent is extended or adjusted under 35 U.S.C. 154(b) by 0 days.

(21) Appl. No.: 14/327,251

(22) Filed: Jul. 9, 2014

(65) Prior Publication Data

US 2016/0010321 A1 Jan. 14, 2016

(51) Int. Cl.
*E04B 1/26* (2006.01)
*E04H 1/12* (2006.01)

(52) U.S. Cl.
CPC .... *E04H 1/1205* (2013.01); *E04B 2001/2632* (2013.01)

(58) Field of Classification Search
CPC ..... E04B 1/26; E04B 2001/262; E04B 2001/2624; E04B 2001/2628; E04B 2001/2632; E04B 2001/2636; E04B 2001/266; E04B 2001/1975
See application file for complete search history.

(56) References Cited

U.S. PATENT DOCUMENTS 1,533,724 A * 4/1925 Clarke-James ..... E04B 1/2604 292/300
2,008,087 A * 7/1935 Stromberg ..... E04B 1/2403 403/189
2,793,407 A * 5/1957 Johnston ..... F16B 12/20 403/182
3,082,492 A * 3/1963 Grubb ..... B27F 1/00 403/381
3,685,866 A * 8/1972 Patenaude ..... E04B 1/2403 403/189
4,019,298 A * 4/1977 Johnson, IV ..... E04B 1/185 403/175
4,894,963 A * 1/1990 Campbell ..... E04B 1/26 52/105
5,244,300 A * 9/1993 Perreira ..... E04B 1/2403 403/263
5,323,584 A * 6/1994 Scarlett ..... E04C 3/14 403/381
7,021,879 B2 * 4/2006 Taneichi ..... F16B 15/0046 403/230
2004/0148900 A1 * 8/2004 Overaas ..... E04B 1/26 52/633
2013/0263554 A1 * 10/2013 Verhaeghe ..... E04B 2/705 52/775

* cited by examiner

*Primary Examiner* — Gisele Ford
(74) *Attorney, Agent, or Firm* — Pia Anderson Moss Hoyt

(57) ABSTRACT

Timber frame structures comprising timber support posts and timber support beams. Improved joint assemblies are utilized for interconnecting the timber support posts and the timber support beams. In particular, each of the joint assemblies includes a tail having a wedge-shaped outer face and a complementary socket configured and dimensioned for receiving the tail. The tails may extend from the terminal faces of the support beams and the sockets may be formed in the sidewalls of the timber support posts. The tails may be installed into the sockets through a drop-in-place procedure. The timber frame structures may be packaged as kits for modular assembly at the desired location.

20 Claims, 18 Drawing Sheets

TIMBER FRAME STRUCTURES WITH IMPROVED JOINT ASSEMBLIES

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. The Field of the Present Disclosure

The present disclosure relates generally to structures, and more particularly, but not necessarily entirely, to timber frame structures.

2. Description of Related Art

Modern timber frame structures provide structural soundness as well an aesthetically pleasing look. Timber framing can be utilized for both interior framing of residential and commercial buildings and for outdoor-frame structures. More recently, there has been a resurgence in the popularity of pergolas, patio covers, trellises, arbors, breeze ways, porte-cocheres, gazebos, awnings, arbors, and decks constructed from heavy timbers.

In its most basic form, a timber frame comprises one or more pairs of vertical support posts. Horizontal support beams may extend between pairs of the posts. The horizontal support beams may in turn support a desired roof or cover. In the past, techniques for mounting the support beams to the support posts included bolts, lags, hangers and other types of mounting hardware. The drawback to these mounting techniques is that they require specialized tools as well as greater degree of skill in order to ensure a secure joint and, therefore, may not be suitable for do-it-yourself installations. Other mounting techniques for securing the support beams to the support posts include mortise and tenon joints. Again, mortise and tenon joints may not be suitable for do-it-yourself installations.

In the past, applicant offered outdoor timber frame structures as do-it-yourself kits. These outdoor timber frame structures included pergolas, patio covers, trellises, arbors, breeze ways, porte-cocheres, gazebos, awnings, arbors, and decks constructed from heavy timbers. For example, as shown in FIG. 1, there is depicted an exemplary timber frame structure 100. The structure 100 comprises vertical support posts 102 and horizontal support beams 104. Decorative end pieces 105, cantilevered support beams, may also be attached to the posts 102 in a similar manner to the support beams 104. The end pieces 105 may appear to be an extension of the support beams 104. The structure 100 further comprises a timber frame cover 106.

In an effort to facilitate assembly of its timber frame structures, applicant previously provided joints for securing the support beams 104 to the support posts 102. In particular, as seen in FIGS. 2-4, each of the terminal ends 107 of the support beams 104 included a tail 108. Each of the tails 108 included a terminal face 111. The terminal faces 111 each included a pair of opposing edges 113. Each of the terminal faces 111 further included a curved edge 115 extending between the edges 113. Extending between the terminal faces 111 of the tails 108 and their corresponding terminal end 107 of the support beam 104 is a sidewall 117. The sidewalls 117 tapered inward to undercut their respective terminal face 111. A topmost portion 117A of the sidewall 117 is not tapered. The dimensions of the previously available tails 108 are shown in FIGS. 2-4. Each of the edges 113 define an imaginary line 113A that intersect with the imaginary line 113A of the other edge 113 to form an angle as shown in FIG. 2.

Referring now to FIG. 5, there is depicted a post 102 having socket 120 configured and adapted to receive the tail 108 (see FIGS. 2-4). The socket 120 may be complementary in shape and size to the tail 108 such that the tail 108 fits snugly into the socket 120. The approximate dimensions of the socket 120 are indicated in FIG. 5, with the understanding that the dimensions are just slightly larger than the tail 108. The tail 108 is installed into the socket 120 by vertically dropping the tail 108 into the socket 120. That is, each of the sockets 120 includes a top entrance such that the tails 108 are slid vertically downward into the sockets 120 via a drop-in-procedure. While effective, the joint formed using the tail 108 and socket 110 had drawbacks, including the tendency to weaken over time and making the structure structurally unsound and prone to warping, twisting, splitting and gap exposure.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the present disclosure will be set forth in the description which follows, and in part will be apparent from the description, or may be learned by the practice of the present disclosure without undue experimentation. The features and advantages of the present disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
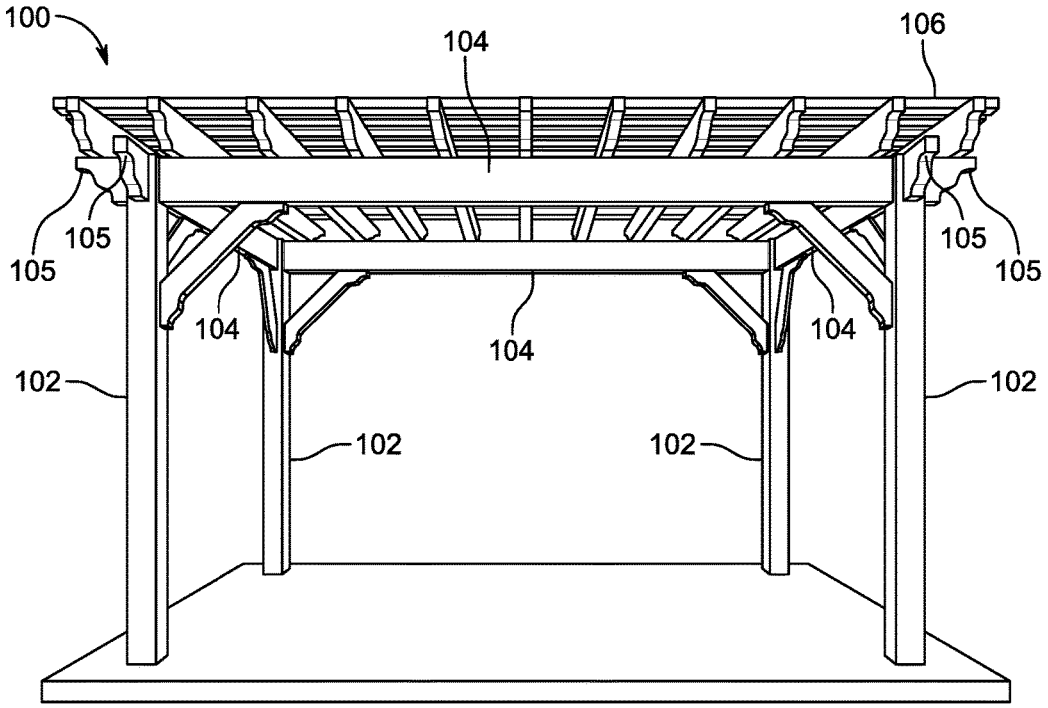
FIG. 1 is a front view of a timber frame structure.
Figure 2:
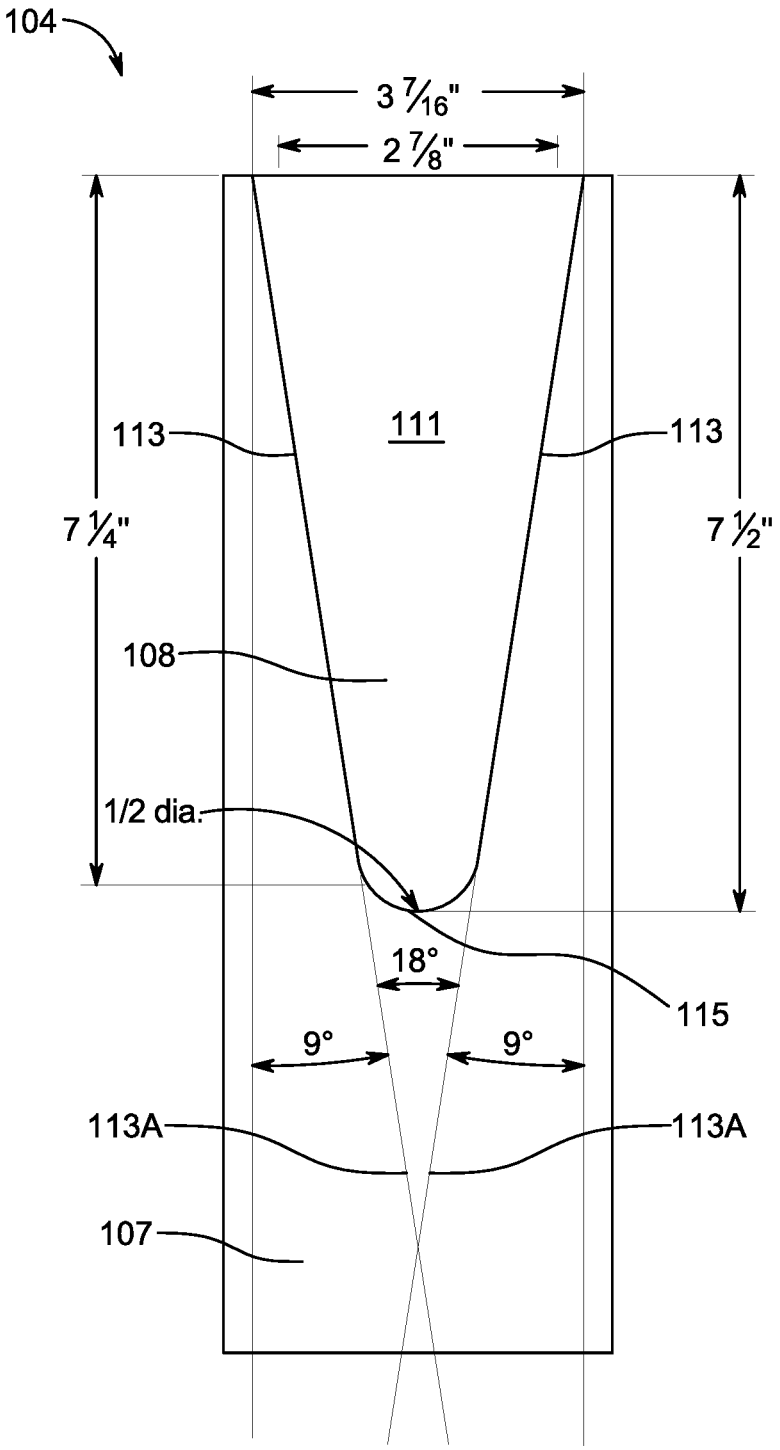
FIG. 2 (Prior Art)
FIG. 2 is an end view of a tail extending from a terminal end of a support beam shown in FIG. 1.
Figure 3:
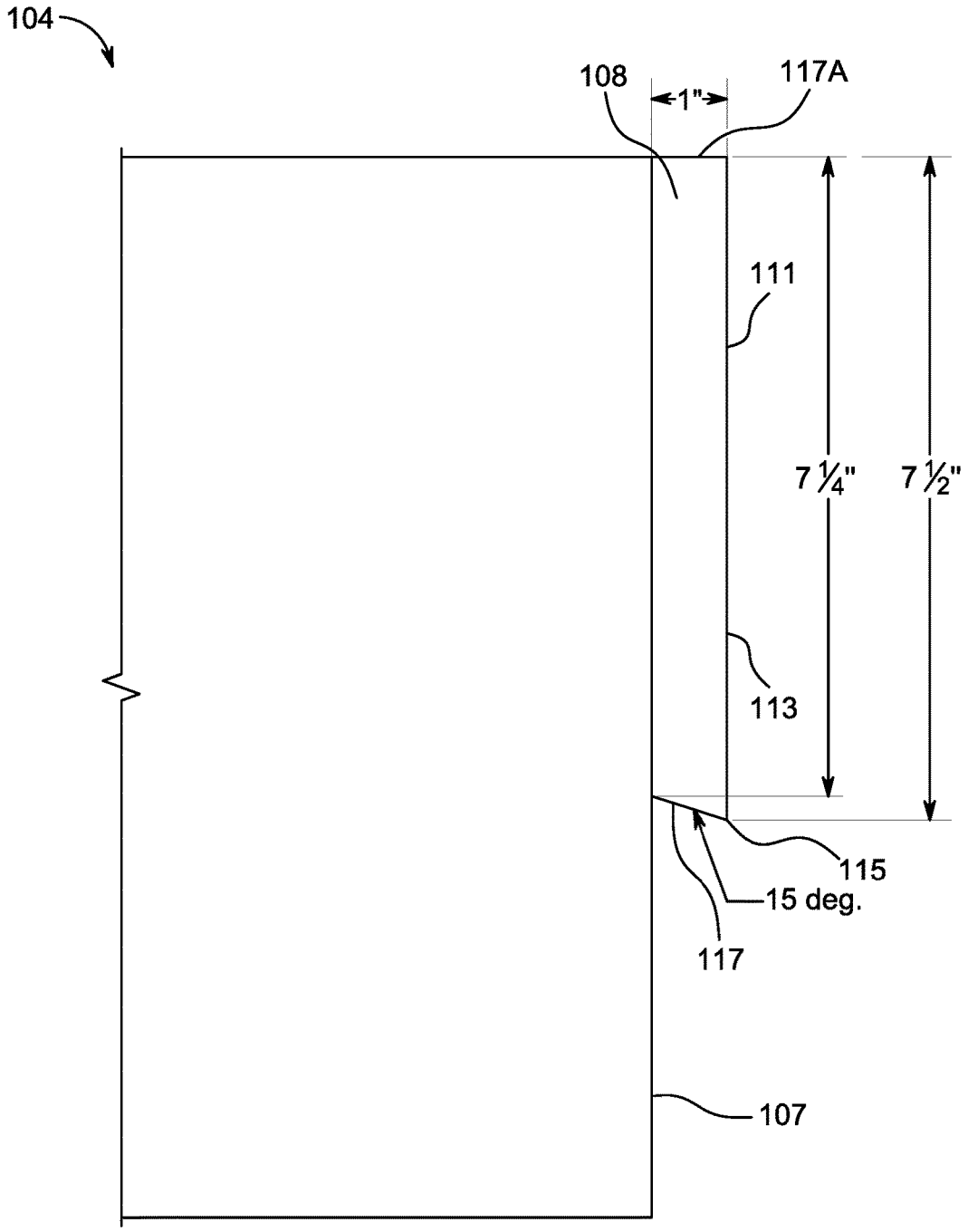
FIG. 3 (Prior Art)
FIG. 3 is a side view of the tail extending from the terminal end of the support beam shown in FIG. 2.
Figure 4:
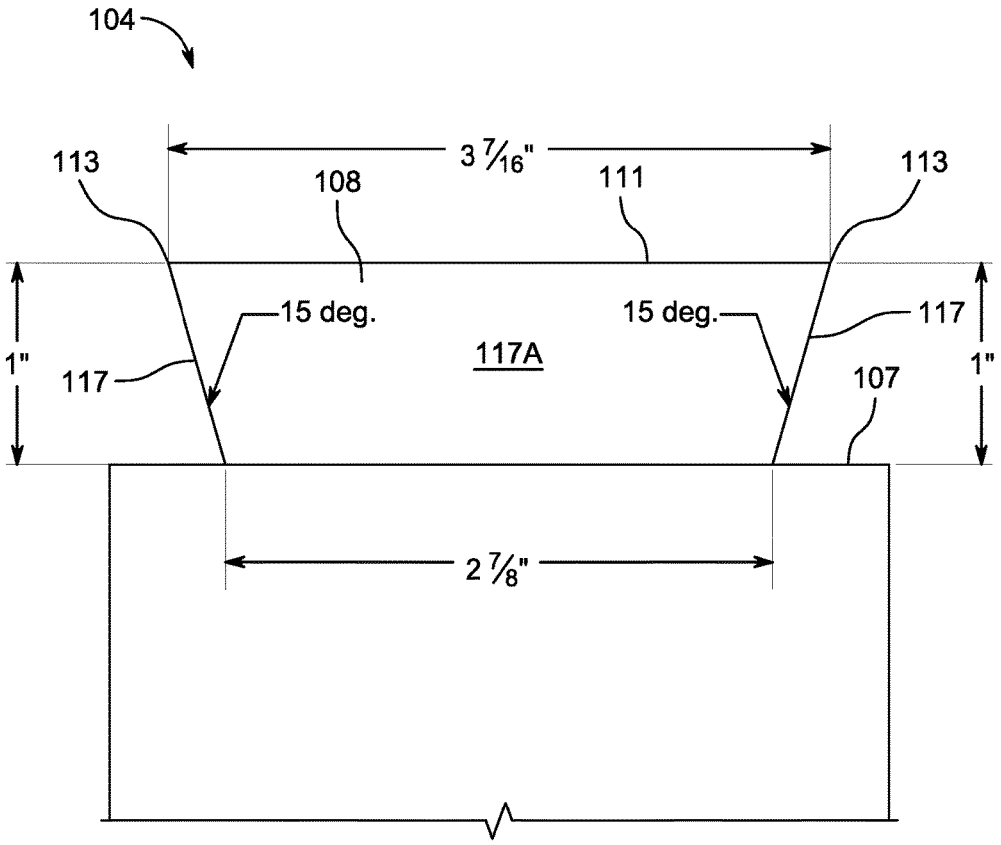
FIG. 4 (Prior Art)
FIG. 4 is a top view of the tail extending from the terminal end of the support beam shown in FIGS. 2 and 3.
Figure 5:
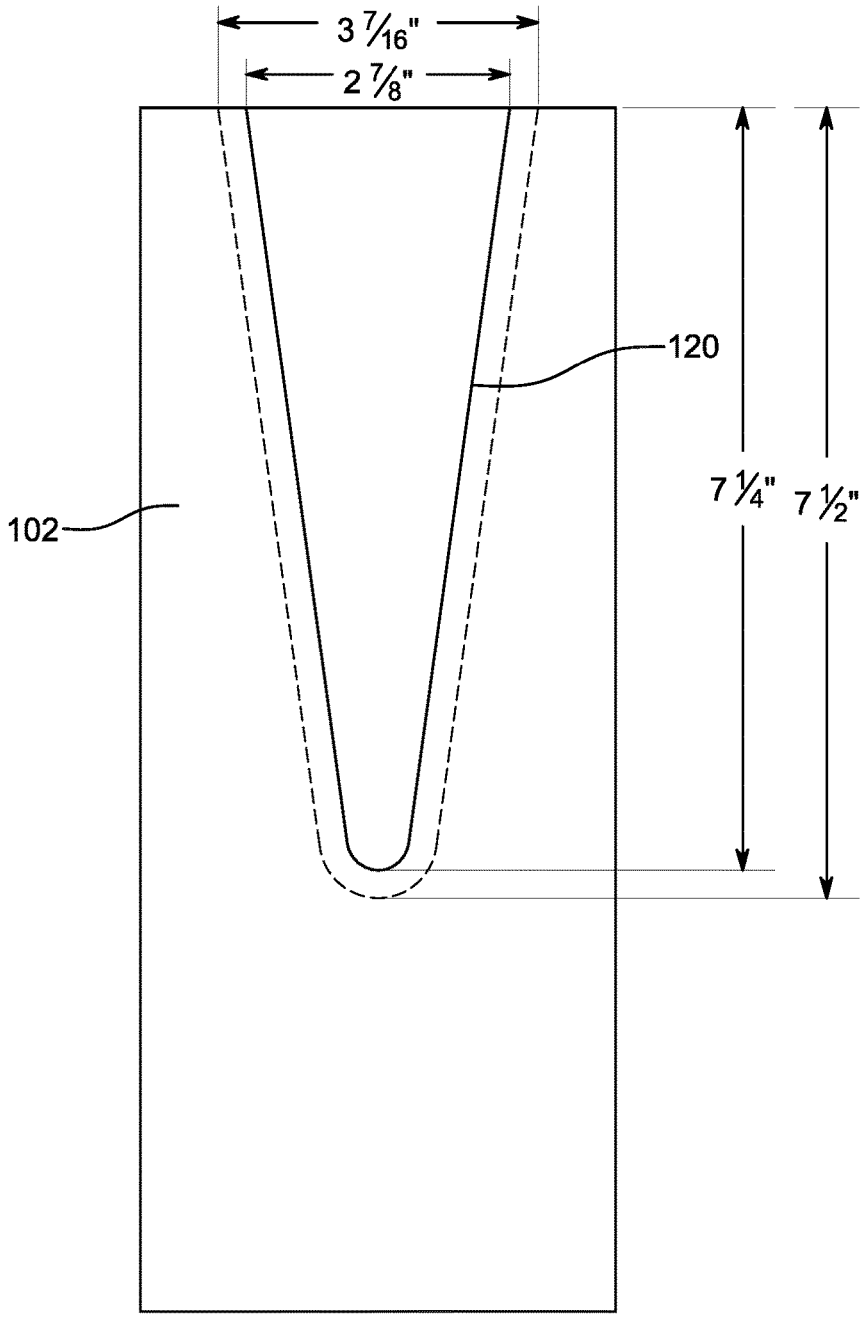
FIG. 5 (Prior Art)
FIG. 5 is a side view of a socket formed in the top end of a support post shown in FIG. 1.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

In describing and claiming the present disclosure, the following terminology will be used in accordance with the definitions set out below. As used in this specification and the appended claims, the singular forms "a," "an," and "the" include plural referents unless the context clearly dictates otherwise. As used herein, the terms "comprising," "including," "containing," "characterized by," and grammatical equivalents thereof are inclusive or open-ended terms that do not exclude additional, unrecited elements or method steps.

Applicant has invented a timber frame structure having an improved joint assembly for attaching adjacent members. In an embodiment, the improved joint assembly may be utilized to secure support beams and end pieces to support posts. The improved joint assembly may comprise a tail extending from a terminal end of a member and a socket formed in another one of the members. The tail may comprise an outer face, an inner face, and a sidewall extending between the outer face and the inner face.

In an embodiment, the outer face is tapered or wedge shaped and comprises a first edge and a second edge. The outer face may further include a curved edge interconnecting the first edge and the second edge. In an embodiment, the first edge and the second edge are straight edges. The first edge and the second edge may each define an imaginary line that intersects with the imaginary line of the other edge to form an angle. In an embodiment, the angle formed by the imaginary lines is between 4 degrees and 12 degrees. In an embodiment, the angle formed by the imaginary lines is between 6 degrees and 10 degrees. In an embodiment, the angle formed by the imaginary lines is approximately 8 degrees. In an embodiment, the inner face may be substantially the same shape as the outer face, except smaller. The inner face may join against the terminal end of the member. In an embodiment, the tail and the member are of unitary construction. In an embodiment, the sidewall extending between the outer face and the inner face is tapered inward to undercut the outer face.

Figure 6A:
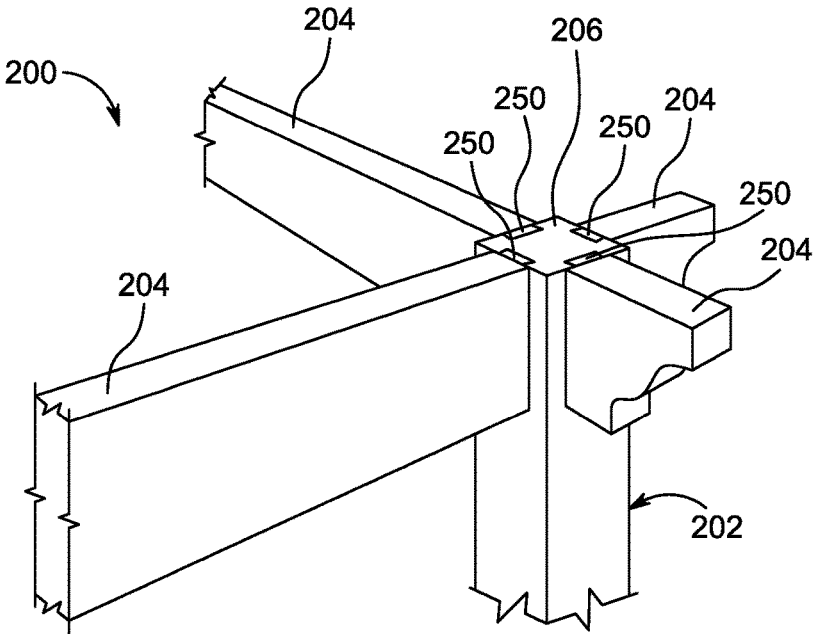
FIG. 6A is a fragmentary, perspective and assembled view of support beams and end pieces attached to a support post according to an embodiment of the present disclosure.
Figure 6B:
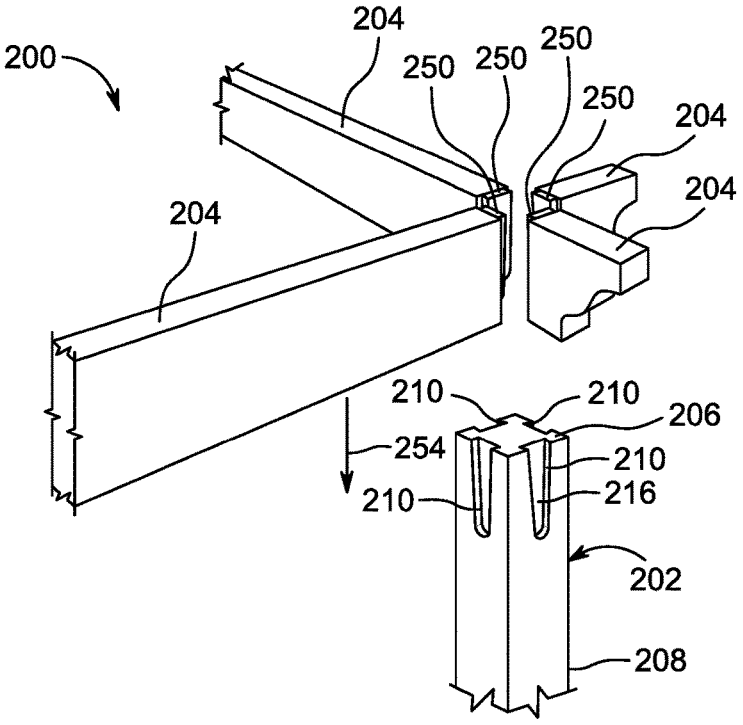
FIG. 6B is a fragmentary, perspective and exploded view of the support beams, the end pieces and the support post shown in FIG. 6A.
Figure 6C:
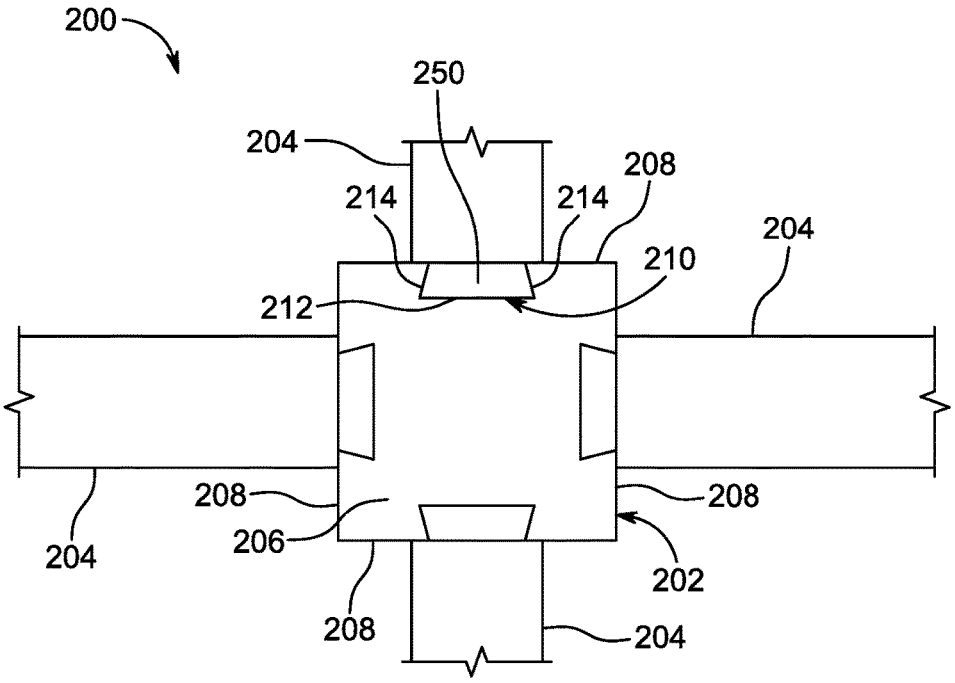
FIG. 6C is a fragmentary, top and assembled view of the support beams and the end pieces attached to the support post shown in FIG. 6A using an improved joint assembly of the present disclosure.

Referring now to FIGS. 6A-6C, there is shown an improved joint assembly 200 for a timber frame structure according to an embodiment of the present disclosure. It will be appreciated that the improved joint assembly 200 may be incorporated into a wide range of timber frame structures, such as the timber frame structure 100 shown in FIG. 1. It will be further appreciated that the improved joint assembly 200 may be utilized with outdoor timber frame structures, including pergolas, patio covers, trellises, breeze ways, porte-cocheres, gazebos, awnings, arbors, decks and other structures constructed from heavy timbers. It will further be appreciated that the improved joint assembly 200 may be utilized for an indoor timber frame structure as well.

The improved joint assembly 200 may comprise a timber post 202 and a plurality of timber support members 204 attached to the post 202. In an embodiment, the timber support members 204 may comprise timber support beams and end pieces. In an embodiment, the support members 204 may extend between two posts 202 or they may be cantilevered. The timber support members 204 may support a timber frame cover or roof.

It will be appreciated that the improved joint assembly 200 may be modified to accommodate one, two, or three timber members 204 attached to the timber post 202 depending on the design of the timber structures into which they are incorporated.

In an embodiment, the post 202 may be vertically oriented with a bottom end (not shown) secured to a support surface, such as the ground. For example, the bottom end (not shown) of the post 202 may be cemented into a post hole formed in the ground. A top end 206 of the post 202 may comprise four sides 208 (see FIG. 6C). In an embodiment, the top end 206 of the post 202 may not comprise four sides.

As best seen in FIG. 6B, formed in each of the sides 208 of the post 202 are sockets 210. In an embodiment, the sockets 210 each comprise a socket entrance at its topmost end. The sockets 210 may be tapered, such that they are widest at their topmost end and narrowest at their bottommost end. As best seen in FIG. 6C, each of the sockets 210 comprises a rear wall 212 that is substantially parallel to one of the corresponding sidewalls 208 of the post 202. The sockets 210 may each further comprise a sidewall 214 that tapers outward such that side openings 216 (see FIG. 6B) of the sockets 210 are narrower than the rear walls 206 of the sockets 204. The sidewall 214 may taper at an angle of approximately 15 degrees. It will be appreciated that the sockets 210 are configured and adapted to receive tails as will be explained in more detail below.

Figure 7A:
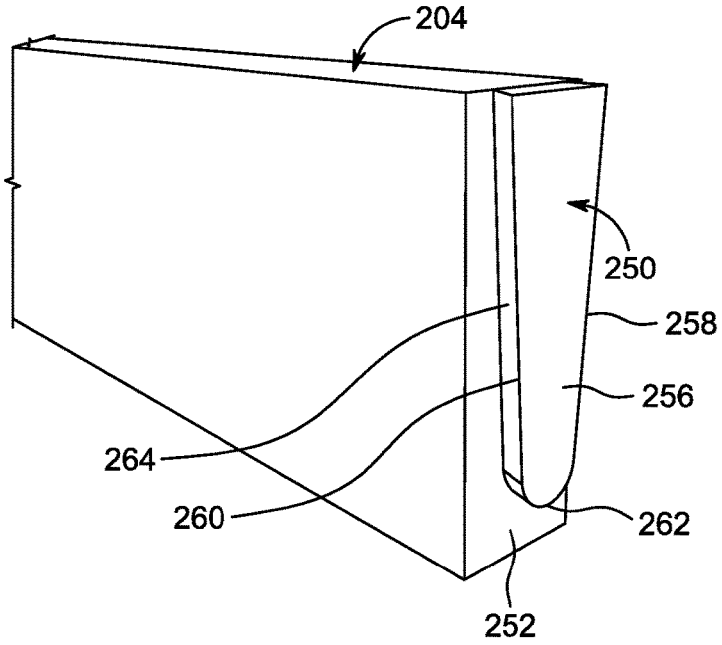
FIG. 7A is a fragmentary, perspective view of a tail extending from a terminal end of a support beam according to an embodiment of the present disclosure.

Referring to FIGS. 6A-6C and FIGS. 7A-7D, extending from a terminal face 252 of each of the timber members 204 is a tail 250 (best seen in FIG. 7A). It will be appreciated that the tails 250 are configured and adapted to be received into the sockets 210 through a drop-in-place procedure as indicated by the arrow 254 in FIG. 6B. In particular, the shape of the sockets 210 are complimentary to that of the tails 250. The tails 250 typically will slide into place under the force of gravity such that an installer only need guide them into place.

Referring now to FIGS. 7A-7D, each tail 250 comprises an outer face 256. In an embodiment, the outer face 256 is substantially planar and wedge shaped and comprises a first edge 258 and a second edge 260. The outer face 256 may further include a curved edge 262 interconnecting the first edge 258 and the second edge 260. In an embodiment, the first edge 258 and the second edge 260 are substantially straight edges. In an embodiment, the curved edge 262 may define a radius between 0.5 and 1 inch. In an embodiment, the curved edge 262 may define a radius of about 0.75 inches.

Each tail 250 further comprises a sidewall 264 extending between the terminal face 252 of the support member 204 and the outer face 256 of the tail 250. In an embodiment, the sidewall 264 is tapered inward to undercut the outer face 256. In an embodiment, the sidewall 264 may form a taper angle of about 15 degrees.

Figure 7B:
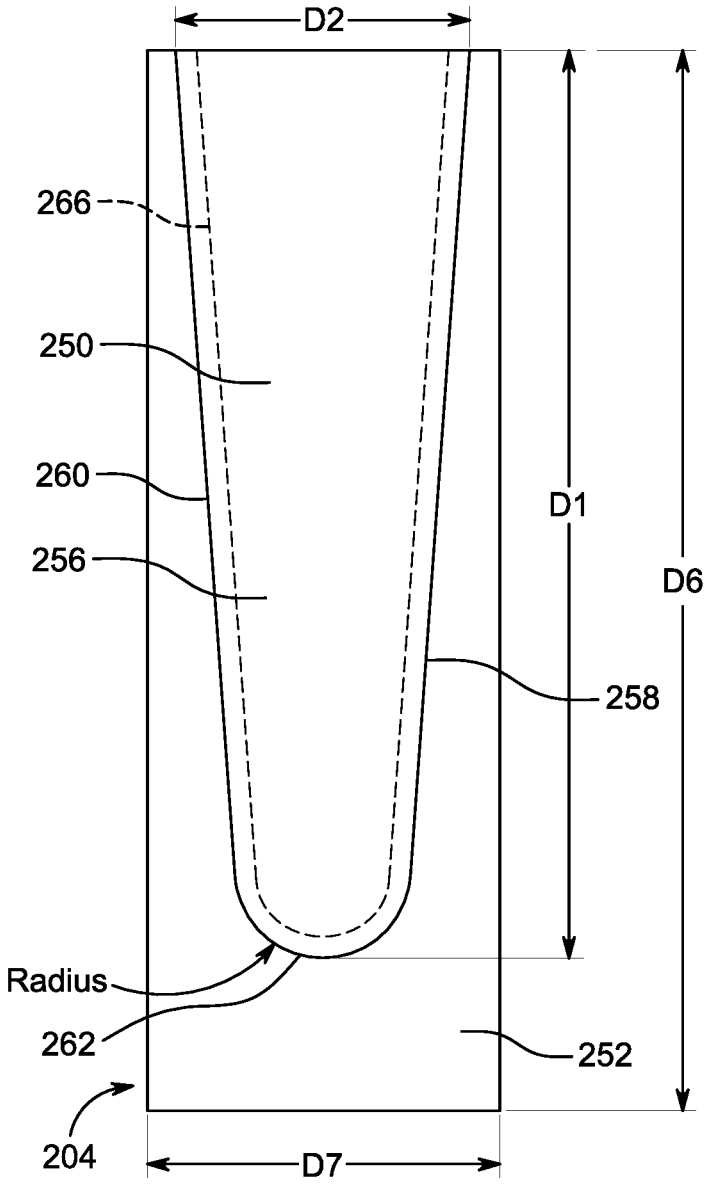
FIG. 7B is an end view of the tail extending from the terminal end of the support beam shown in FIG. 7A according to an embodiment of the present disclosure.

In this regard, each tail 250 defines an inner face indicated by the dashed line 266 in FIG. 7B. (The inner face lies on the intersection between the terminal face 252 of the member 204 and the tail 250.) The inner face may be similar in shape to the outer face 256, except that the inner face is smaller due to the taper of the sidewall 264. In an embodiment, the tail 250 and the timber member 204 are formed from the same piece of timber.

Figure 7C:
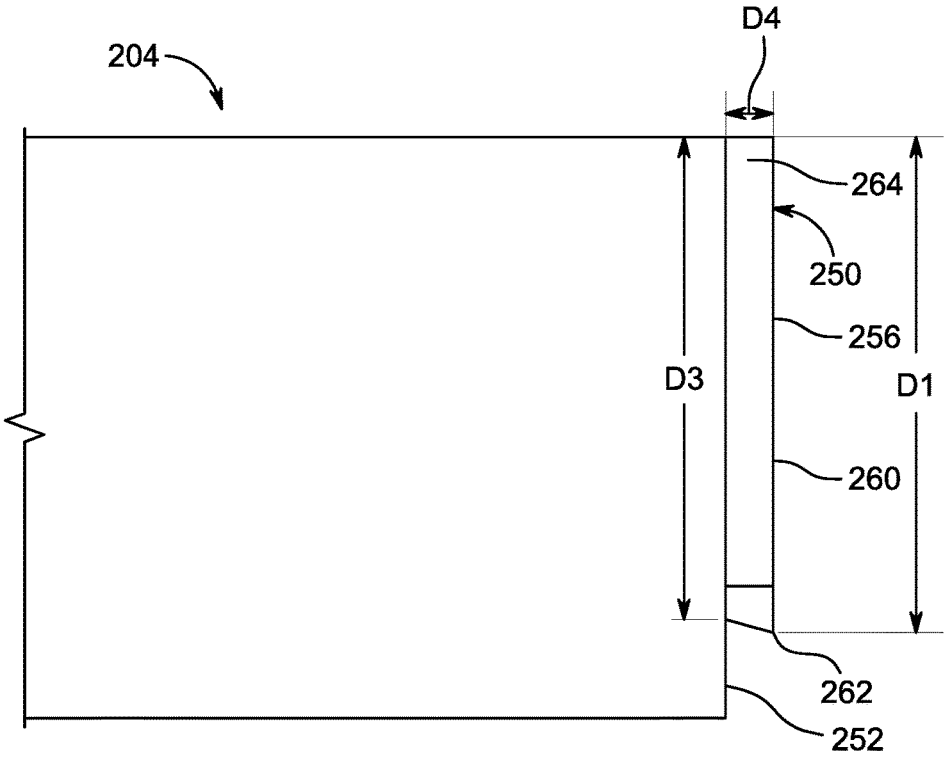
FIG. 7C is a fragmentary, side view of the tail extending from the terminal end of the support beam shown in FIGS. 7A and 7B according to an embodiment of the present disclosure.
Figure 7D:
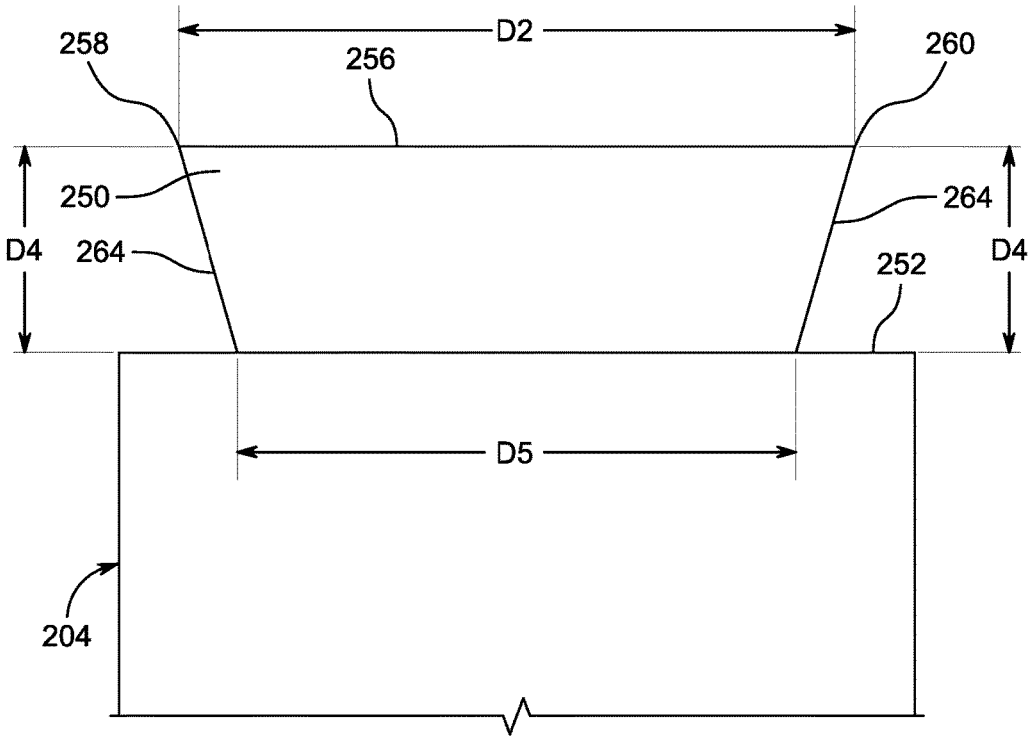
FIG. 7D is a fragmentary, top view of the tail extending from the terminal end of the support beam shown in FIGS. 7A-7C according to an embodiment of the present disclosure.

Referring now to FIGS. 7B-7D, the outer face 256 has a height of D1. The topmost portion of the outer face 256 has a width of D2, which is the maximum width of the outer face 256. A distance between the outer face 256 between the outer face 256 and the terminal face 252 of the member 204 is D4. The inner face of the tail 250 may have a height of D3 while the topmost portion of the inner face has a width of D5, which is the maximum width of the inner face.

In an embodiment, the value of D1 may fall within any one of the following ranges: 8 to 12 inches, 9 to 11 inches, 9 to 10 inches, and 10 to 11 inches. In an embodiment, the value of D1 is one of 9.25 inches and 10.25 inches.

In an embodiment, the value of D2 may fall within any one of the following ranges: 1 to 5 inches, 2 to 4 inches, 2 to 3 inches, and 3 to 4 inches. In an embodiment, the value of D2 is one of 2.25 inches and 3.25 inches.

In an embodiment, the value of D3 may fall within any one of the following ranges: 8 to 12 inches, 9 to 11 inches, 9 to 10 inches, and 10 to 11 inches. In an embodiment, the value of D3 is one of 9 inches and 10 inches.

In an embodiment, the value of D4 may fall within any one of the following ranges: 0.5 to 3 inches, and 0.75 to 1.25 inches. In an embodiment, the value of D4 is 1 inch.

In an embodiment, the value of D5 may fall within any one of the following ranges: 1 to 4 inches, and 1.5 to 3 inches. In an embodiment, the value of D5 is one of 1.75 inches and 2.75 inches.

Referring now to FIG. 7B, the timber member 204 may define a height D6 and a width D7. In an embodiment, the value of D6 may fall within any one of the following ranges: 6 inches to 20 inches. In an embodiment, the value of D6 is one of 10 inches and 12 inches. In an embodiment, the value of D7 may fall within any one of the following ranges: 2 inches to 10 inches. In an embodiment, the value of D7 is one of 3 inches and 4 inches. In an embodiment, the timber member 204 has a cross sectional dimension of 2 inches by 6 inches up to and through the various sizes of 10 inches by 16 inches. In an embodiment, the timber member 204 has a cross sectional dimension of 3 inches by 8 inches through 6 inches by 14 inches. In an embodiment, the timber member 204 has the dimensions of 3 inches by 10 inches or 4 inches by 12 inches.

In an embodiment, the post 202 may have a rectangular dimensions, where each side ranges from 4 inches to 16 inches. In an embodiment, the post 202 dimensions are one of 6 inches by 6 inches and 8 inches by 8 inches.

Figure 7E:
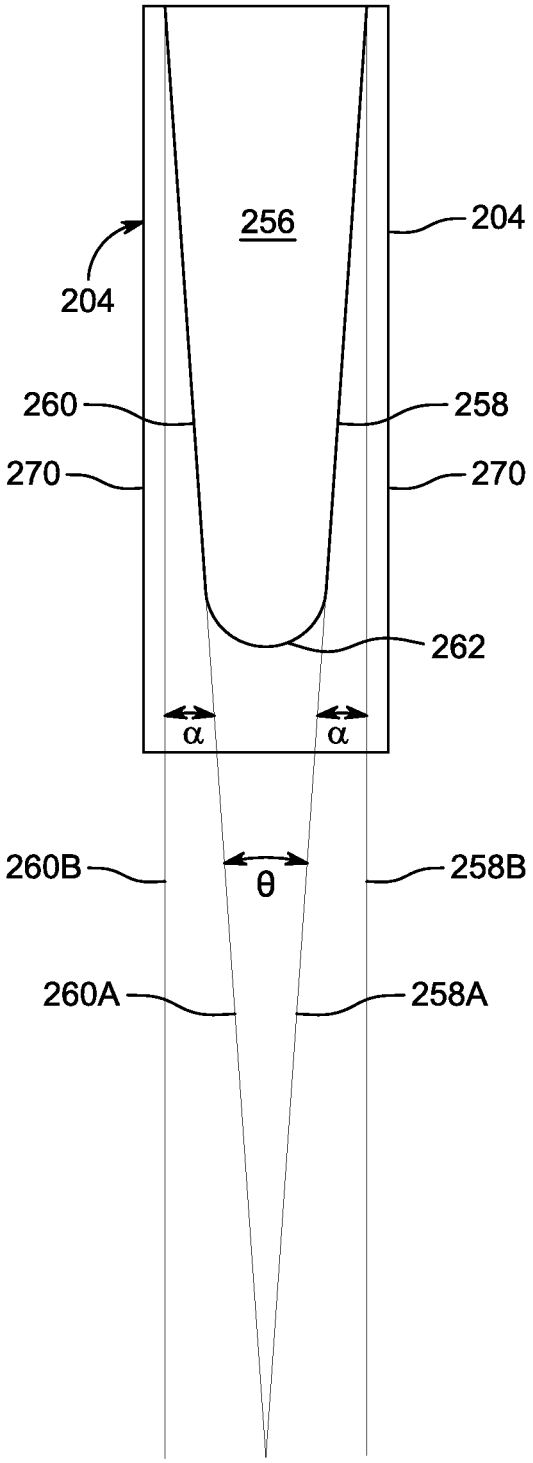
FIG. 7E is an end view of the tail extending from the terminal end of the support beam shown in FIGS. 7A-7D according to an embodiment of the present disclosure.

Referring now to FIG. 7E, the first edge 258 and the second edge 260 may define imaginary lines 258A and 260A, respectively, that intersect with each other edge to form an angle, θ. In an embodiment, the angle θ formed by the imaginary lines 258A and 260A is between 4 degrees and 12 degrees. In an embodiment, the angle θ formed by the imaginary lines 258A and 260A is between 6 degrees and 10 degrees. In an embodiment, the angle θ formed by the imaginary lines 258A and 260A is approximately 8 degrees.

The first edge 258 and the second edge 260 may define an angle α with imaginary lines 258B and 260B. The imaginary lines 258B and 260B may be parallel to each other and to the vertical sidewalls 270 of the timber member 204. In an embodiment, the angle α formed by the imaginary lines 258B and 260B is between 2 degrees and 8; degrees. In an embodiment, the angle α formed by imaginary lines 258B and 260B is between 3 degrees and 8 degrees. In an embodiment, the angle α formed by imaginary lines 258B and 260B is approximately 4 degrees.

Figure 8:
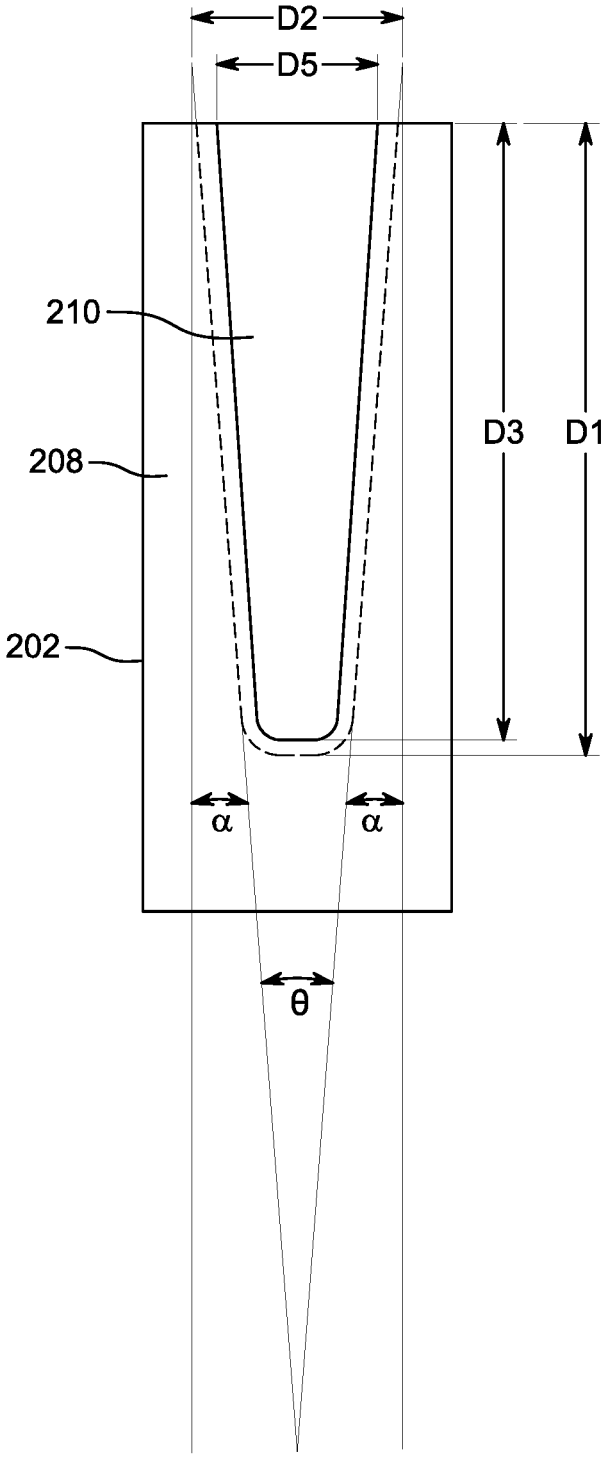
FIG. 8 is a side view of a socket formed in the top end of a support post according to an embodiment of the present disclosure.

Referring now to FIG. 8, there is depicted a side view of one of the socket 210 formed in a side 208 of the post 202. As mentioned above, the socket 210 is complementary in shape to the tail 250. As used herein, the term "complementary" means that the socket 210 and the tail 250 fit together with precision, like a hand in a glove or a key into a lock. In this regard, the space defined by the socket 210 has approximately the same dimensions of D1, D2, D3, D4, and D5 as the tail 250, except that the dimensions may be slightly larger to insure proper fit of the tail 250. Further, the socket 210 defines the same angles θ and α as the tail 250.

It will be appreciated that the structure and apparatus disclosed herein is merely one example of a means for joining timber frame members, and it should be appreciated that any structure, apparatus or system for joining timber frame members which performs functions the same as, or equivalent to, those disclosed herein are intended to fall within the scope of a means for joining timber frame members, including those structures, apparatus or systems for joining timber frame members which are presently known, or which may become available in the future. Anything which functions the same as, or equivalently to, a means for joining timber frame members falls within the scope of this element.

It will be appreciated that an aspect of the present invention includes providing the improved joint assembly for timber frame structures as a part of a kit. In particular, the kit may include precut timber that may be assembled to form a timber frame structure. In an embodiment, the kit for the timber frame structure forms one of a pergola, patio cover, trellis, breeze way, porte-cochere, gazebo, awning, arbor, and deck.

Figure 9:
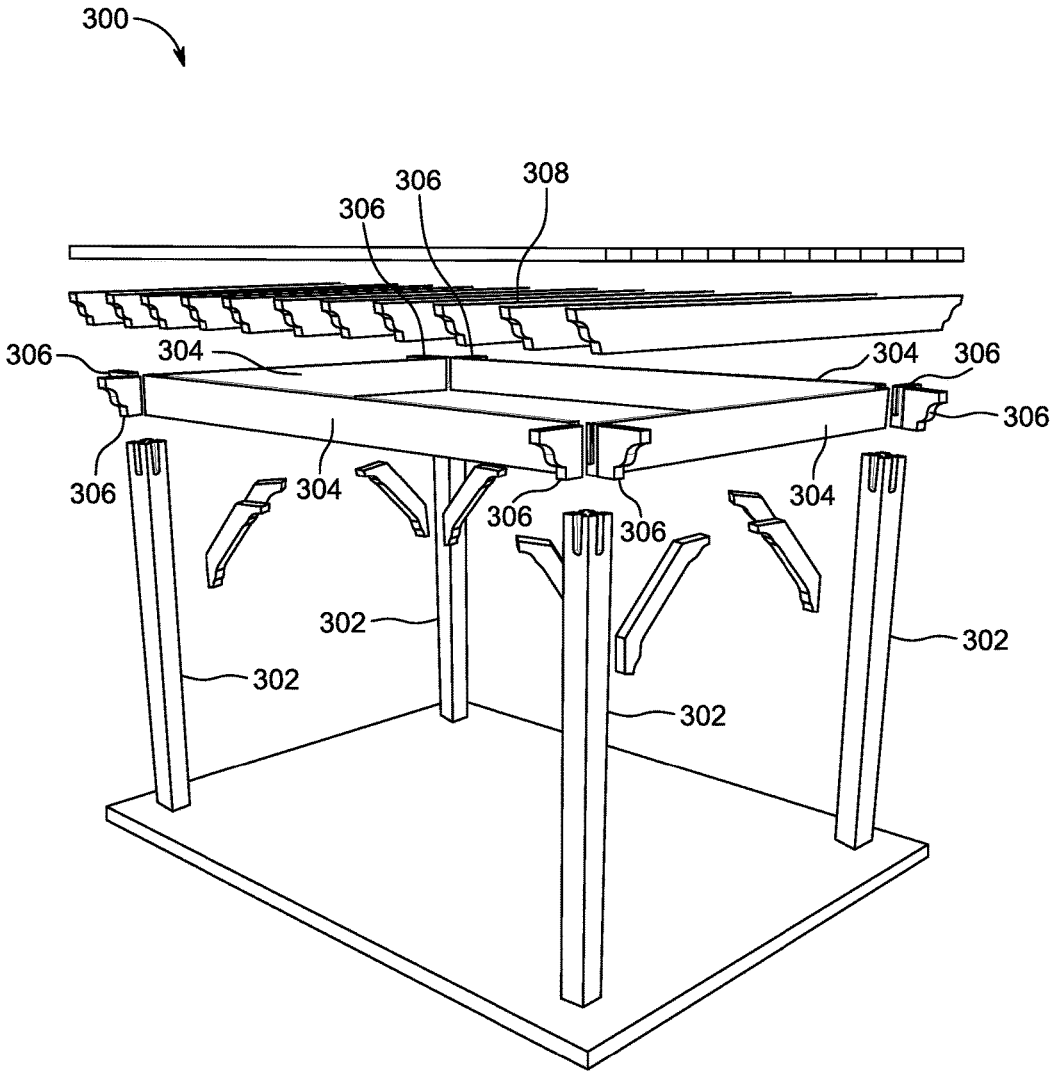
FIG. 9 depicts an exploded view of a kit of a timber frame structure according to an embodiment of the present disclosure.

For example, as shown in FIG. 9, there is shown an exploded view of a kit of a timber frame pergola structure 300 according to an embodiment of the present disclosure. The pergola structure 300 may include timber posts 302, timber support beams 304, timber end pieces 306 and a timber cover 308. The pergola structure 300 may include the improved joint assembly described herein between the timber posts 302, the timber support beams 304, and the timber end pieces 306.

Figure 10:
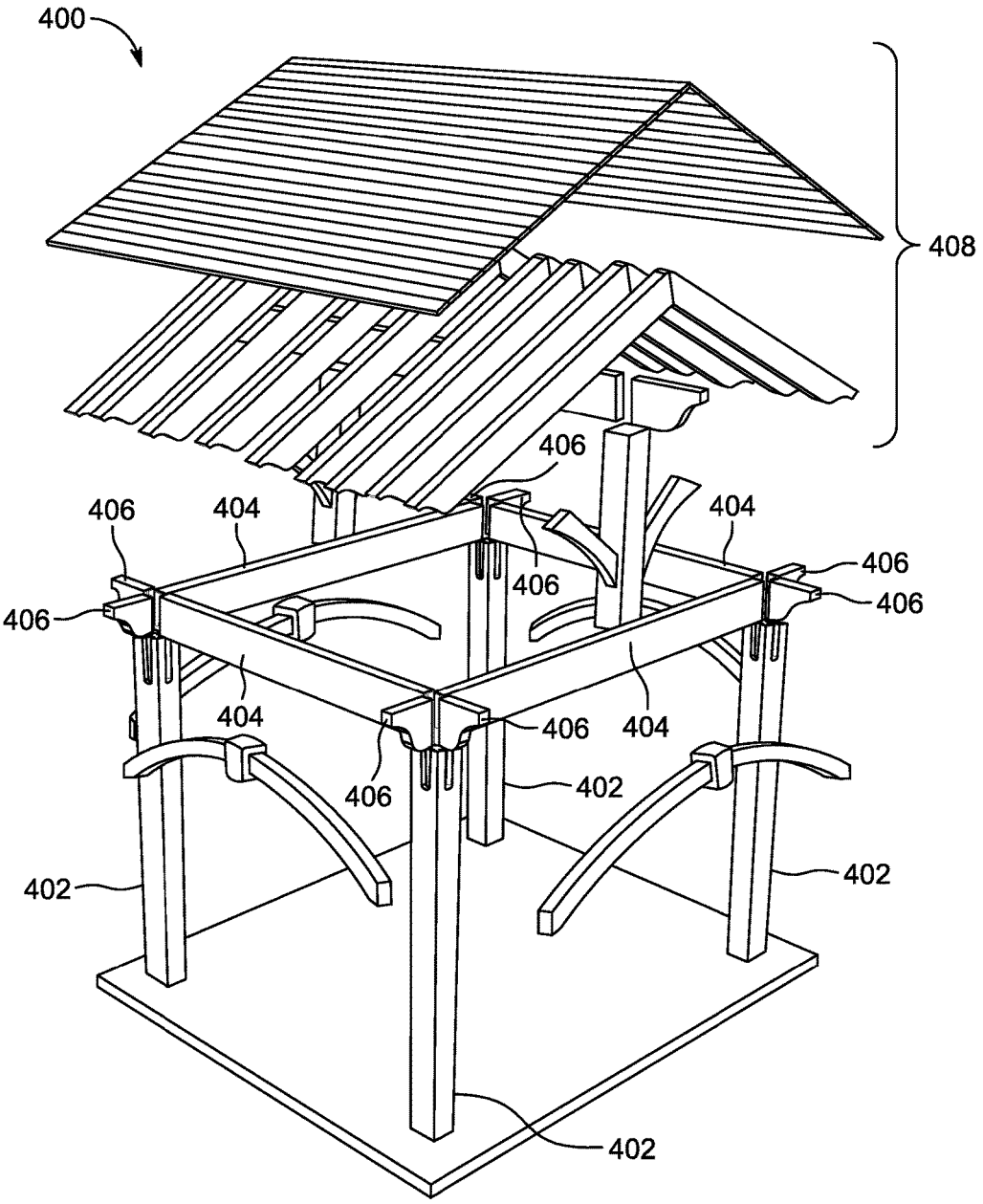
FIG. 10 depicts an exploded view of a kit of a timber frame structure according to an embodiment of the present disclosure.

By way of further example, as shown in FIG. 10, there is shown an exploded view of a kit of a timber frame pavilion structure 400 according to an embodiment of the present disclosure. The pavilion structure 400 may include timber posts 402, timber support beams 404, timber end pieces 406 and a timber cover 408. The pavilion structure 400 may include the improved joint assembly described herein between the timber posts 402, the timber support beams 404, and the timber end pieces 406.

Figure 11:
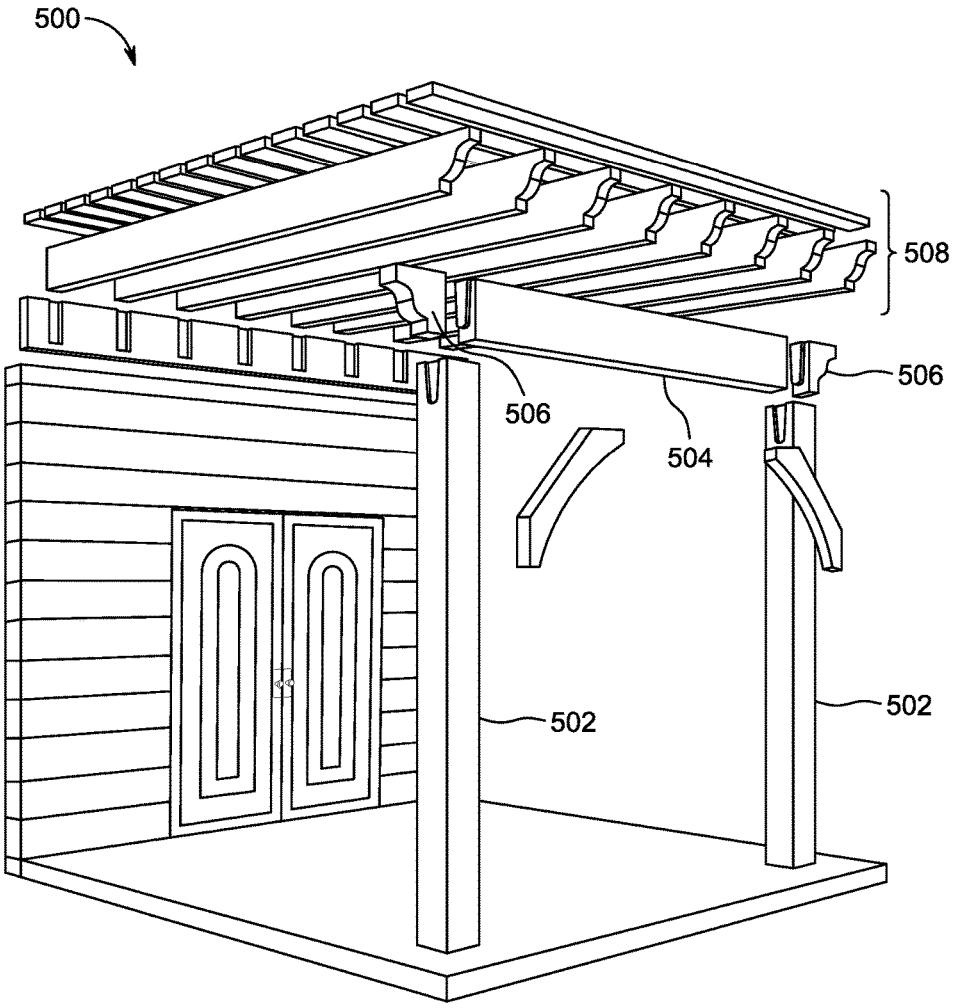
FIG. 11 depicts an exploded view of a kit of a timber frame structure according to an embodiment of the present disclosure.

By way of further example, as shown in FIG. 11, there is shown an exploded view of a kit of a timber frame patio structure 500 according to an embodiment of the present disclosure. The patio structure 500 may include timber posts 502, a timber support beam 504, timber end pieces 506 and a timber cover 508. The pavilion structure 500 may include the improved joint assembly described herein between the timber posts 502, the timber support beam 504, and the timber end pieces 506.

Figure 12:
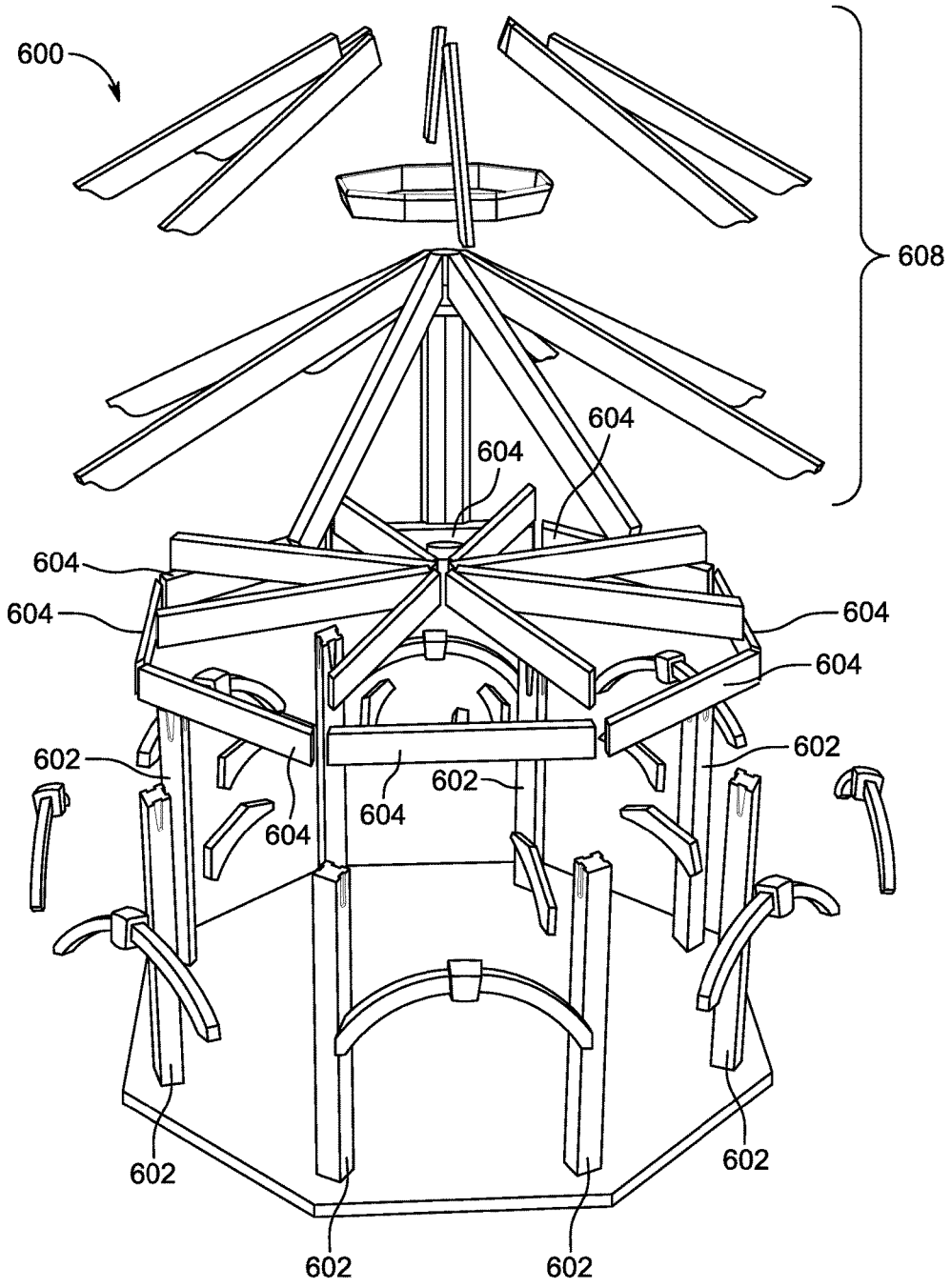
FIG. 12 depicts an exploded view of a kit of a timber frame structure according to an embodiment of the present disclosure.

By way of further example, as shown in FIG. 12, there is shown an exploded view of a kit of a timber frame gazebo structure 600 according to an embodiment of the present disclosure. The gazebo structure 600 may include timber posts 602, timber support beams 604, and a timber cover 608. The gazebo structure 600 may include the improved joint assembly described herein between the timber posts 602 and timber support beams 604.

Figure 13:
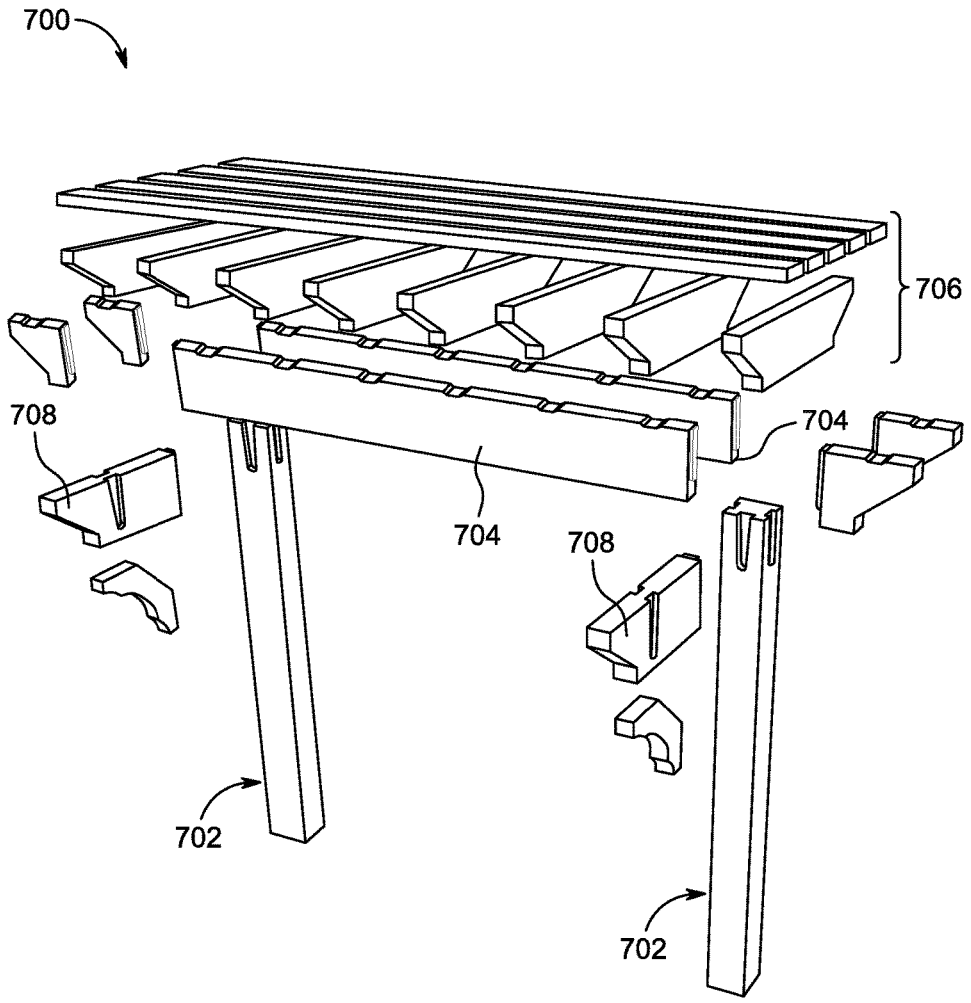
FIG. 13 depicts an exploded view of a kit of a timber frame structure according to an embodiment of the present disclosure.

By way of further example, as shown in FIG. 13, there is shown an exploded view of a kit of a timber frame trellis structure 700 according to an embodiment of the present disclosure. The structure 700 may include timber posts 702, timber support beams 704, and a timber cover 706. The structure 700 may include the improved joint assembly described herein between the timber posts 702 and one of the timber support beams 704. In addition, the structure 700 may include the improved joint assembly described herein between cantilevered support beams 708 and the other of the timber support beams 704.

Figure 14:
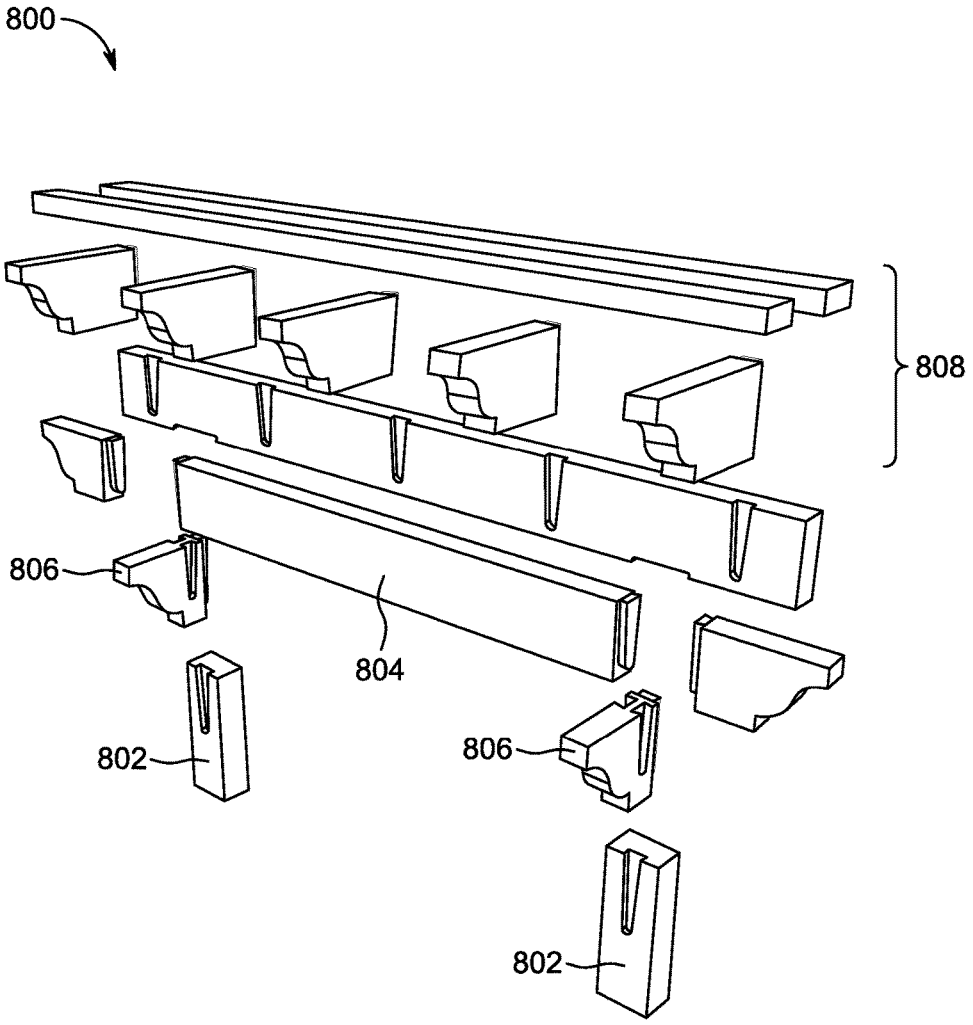
FIG. 14 depicts an exploded view of a kit of a timber frame structure according to an embodiment of the present disclosure.

By way of further example, as shown in FIG. 14, there is shown an exploded view of a kit of a timber frame arbor structure 800 according to an embodiment of the present disclosure. The structure 800 may include timber posts 802, a timber support beam 804, cantilevered timber support beams 806, and a timber cover 808. The structure 800 may include the improved joint assembly described herein between the timber posts 802 and the cantilevered timber support beams 806. In addition, the structure 800 may include the improved joint assembly described herein between the support beam 804 and the cantilevered support beams 806.

According to an aspect of the present invention, a timber frame structure comprises:

at least one timber support post;

at least one timber support beam;

a joint assembly for interconnecting the at least one timber support post and the at least one timber support beam, the joint assembly comprising:

(i) a tail, said tail comprising a wedge-shaped outer face having a first edge and a second edge, each of the first edge and the second edge defining an imaginary line that intersects with an imaginary line of the other one of the first edge or the second edge, wherein the intersection of the imaginary lines define an angle, wherein the angle is between 4 and 12 degrees, and (ii) a socket configured and dimensioned for receiving the tail.

According to another aspect of the present invention, the angle formed between the imaginary lines is between 6 and 10 degrees. According to another aspect of the present invention, the angle formed between the imaginary lines is approximately 8 degrees. According to another aspect of the present invention, the outer face has a length of between 8 to 12 inches. According to another aspect of the present invention, the outer face has a length of one of approximately 9.25 inches and 10.25 inches. According to another aspect of the present invention, a maximum width of the outer face is between 2 to 4 inches. According to another aspect of the present invention, the maximum width of the outer face is one of 2.25 inches and 3.25 inches. According to another aspect of the present invention, the outer face further comprises a curved portion interconnecting the first edge and the second edge. According to another aspect of the present invention, the curved portion has a radius of between 0.5 and 1 inches. According to another aspect of the present invention, the radius is about 0.75 inches. According to another aspect of the present invention, the at least one support beam has a cross sectional dimension of 4 inches by 12 inches. According to another aspect of the present invention, the at least one post has a cross sectional dimension of 8 inches by 8 inches. According to another aspect of the present invention, the timber structure is one of a pergola, a patio cover, a pavilion, trellis, arbor and a gazebo. According to another aspect of the present invention, the socket is complementary in shape to the tail. According to another aspect of the present invention, the tail extends from a terminal face of the at least one support beam and the socket is formed in the at least one post. According to another aspect of the present invention, the at least one support beam supports a timber frame cover. According to another aspect of the present invention, the tail further comprises an inner face and a sidewall extending between the outer face and the inner face, wherein the inner face has the same shape as the outer face but is smaller in size than the outer face, wherein the sidewall undercuts the outer face.

According to an aspect of the present invention, a kit for modular assembly of a timber frame structure comprises:

a plurality of timber support posts;

a plurality of timber support beams;

joint assemblies for interconnecting the plurality of timber support posts and the plurality of timber support beams, each joint assembly comprising, (i) a tail, said tail comprising a wedge-shaped outer face having a first edge and a second edge, each of the first edge and the second edge defining an imaginary line that intersects with an imaginary line of the other one of the first edge or the second edge, wherein the intersection of the imaginary lines define an angle, wherein the angle is approximately 8 degrees, and (ii) a socket configured and dimensioned for receiving the tail, wherein the socket is complementary in shape to the tail.

According to an aspect of the present invention, the tail of the kit further comprises an inner face and a sidewall extending between the outer face and the inner face, wherein the inner face has the same shape as the outer face but is smaller in size than the outer face, wherein the sidewall undercuts the outer face.

According to an aspect of the present invention, a kit for modular assembly of a timber frame structure in situ comprises:

a plurality of timber support posts;

a plurality of timber support beams; and a means for joining the plurality of timber support posts to the plurality of timbers support beams.

Those having ordinary skill in the relevant art will appreciate the advantages provide by the features of the present disclosure. For example, it is a feature of the present disclosure to provide timber structures that may be assembled without the use of hardware. Another feature of the present disclosure to provide such a timber structure with an improved joint assembly between the timber members of the structure. It is a further feature of the present disclosure, in accordance with one aspect thereof, to provide an improved joint assembly for use in kits for assembling outdoor timber frame structures in situ.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A timber frame structure comprising:

at least one timber support post;

at least one timber support beam;

a joint assembly for interconnecting the at least one timber support post and the at least one timber support beam, the joint assembly comprising:

(i) a tail, said tail comprising a wedge-shaped outer face having a first edge and a second edge, each of the first edge and the second edge defining an imaginary line that intersects with an imaginary line of the other one of the first edge or the second edge, wherein the intersection of the imaginary lines define an angle, wherein the angle is between 4 and 12 degrees, and (ii) a socket configured and dimensioned for receiving the tail.

2. The timber frame structure of claim 1, wherein the angle is between 6 and 10 degrees.

3. The timber frame structure of claim 2, wherein the angle is approximately 8 degrees.

4. The timber frame structure of claim 3, wherein the outer face has a length of between 8 to 12 inches.

5. The timber frame structure of claim 4, wherein the outer face has a length of one of approximately 9.25 inches and 10.25 inches.

6. The timber frame structure of claim 5, wherein a maximum width of the outer face is between 2 to 4 inches.

7. The timber frame structure of claim 6, wherein the maximum width of the outer face is one of 2.25 inches and 3.25 inches.

8. The timber frame structure of claim 7, wherein the outer face further comprises a curved portion interconnecting the first edge and the second edge.

9. The timber frame structure of claim 8, wherein the curved portion has a radius of between 0.5 and 1 inches.

10. The timber frame structure of claim 9, wherein the radius of about 0.75 inches.

11. The timber frame structure of claim 10, wherein the at least one support beam has a cross sectional dimension of 4 inches by 12 inches.

12. The timber frame structure of claim 11, wherein the at least one post has a cross sectional dimension of 8 inches by 8 inches.

13. The timber frame structure of claim 1, wherein the timber structure is one of a pergola, a patio cover, a pavilion, trellis, an arbor and a gazebo.

14. The timber frame structure of claim 1, wherein the socket is complementary in shape to the tail.

15. The timber frame structure of claim 14, wherein the tail extends from a terminal face of the at least one support beam and the socket is formed in the at least one post.

16. The timber frame structure of claim 1, wherein the at least one support beam supports a timber frame cover.

17. The timber frame structure of claim 1, wherein the tail further comprises a sidewall adjacent the outer face, wherein the sidewall undercuts the outer face.

18. A kit for modular assembly of a timber frame structure, said kit comprising:

a plurality of timber support posts;

a plurality of timber support beams; joint assemblies for interconnecting the plurality of timber support posts and the plurality of timber support beams, each joint assembly comprising:

(i) a tail, said tail comprising a wedge-shaped outer face having a first edge and a second edge, each of the first edge and the second edge defining an imaginary line that intersects with an imaginary line of the other one of the first edge or the second edge, wherein the intersection of the imaginary lines define an angle, wherein the angle is approximately 8 degrees, and (ii) a socket configured and dimensioned for receiving the tail, wherein the socket is complementary in shape to the tail.

19. The kit according to claim 17, wherein the tail further comprises a sidewall adjacent the outer face, wherein the sidewall undercuts the outer face.

20. A kit for modular assembly of a timber frame structure in situ, said kit comprising: a plurality of timber support posts; a plurality of timber support beams; and a means for joining the plurality of timber support posts to the plurality of timbers support beams.

* * * * *